US006021646A

United States Patent [19]

Burley et al.

[11] Patent Number: 6,021,646

[45] Date of Patent: Feb. 8, 2000

[54] FLOOR SYSTEM FOR A RINK

[75] Inventors: John S. Burley; Michael R. Moncilovich, both of Johnstown; John Charles Hicks, Jr., Barnesboro, all of Pa.

[73] Assignee: Burley's Rink Supply, Inc., Johnstown, Pa.

[21] Appl. No.: 09/105,151

[22] Filed: Jun. 26, 1998

[51] Int. Cl.[7] ..... F25C 3/02

[52] U.S. Cl. ..... 62/235; 165/45; 472/92

[58] Field of Search ..... 62/235; 472/92; 165/45, 46; 237/69

[56] References Cited

U.S. PATENT DOCUMENTS

| | | | |
|---|---|---|---|
| 2,257,219 | 9/1941 | Bath . | |
| 2,811,850 | 11/1957 | Clary | 237/69 |
| 3,379,031 | 4/1968 | Lewis, Jr. . | |
| 3,405,534 | 10/1968 | Sullivan . | |
| 3,538,719 | 11/1970 | Pradel . | |
| 3,621,671 | 11/1971 | Ullrich . | |
| 3,721,418 | 3/1973 | Vincent . | |
| 3,751,935 | 8/1973 | MacCracken et al. . | |
| 3,771,891 | 11/1973 | Nirenski et al. . | |
| 3,946,529 | 3/1976 | Chevaux . | |
| 4,191,243 | 3/1980 | Donzis | 237/69 |
| 4,394,817 | 7/1983 | Remillard . | |
| 4,513,583 | 4/1985 | Watt . | |
| 4,551,985 | 11/1985 | Kovach . | |
| 4,703,597 | 11/1987 | Eggemar . | |
| 4,782,889 | 11/1988 | Bourne | 237/69 |
| 4,979,373 | 12/1990 | Huppee . | |
| 5,027,613 | 7/1991 | Pare | 62/235 |
| 5,087,030 | 2/1992 | Jones . | |
| 5,251,689 | 10/1993 | Hakim-Elahi . | |
| 5,327,737 | 7/1994 | Eggemar . | |

FOREIGN PATENT DOCUMENTS

| | | |
|---|---|---|
| 1285728 | 7/1962 | France . |
| 1 281 455 | 10/1968 | Germany . |
| 2 038 080 | 4/1971 | Germany . |
| 29 40 945 A1 | 4/1981 | Germany . |

OTHER PUBLICATIONS

Popular Science Magazine, Home Technology, Phillips, William G., *Heating* "Hot Feet," Apr. 1998, p. 43.

*Primary Examiner*—William E. Tapolcai
*Attorney, Agent, or Firm*—Banner & Witcoff, Ltd.

[57] ABSTRACT

A floor system having the versatility to be used for ice or in-line skating, ice, in-line, or floor hockey, or any other of a whole host of activities. The floor system includes a number of floor elements that extend the length of the playing or skating surface. The floor elements are interlocked with its adjacent floor elements to form a completed continuous upper planar surface. Supports, having fluid channels therein, support the planar upper surface a fixed distance from a foundation. The upper planar surface has a plurality of holes therein to permit fluid communication between the passages below the upper surface and the region immediately above the upper surface. This arrangement enhances the strength of the ice surface as the water that freezes inside the holes prevents portions of the ice from shearing off. Ice level indicators are frozen within the ice to provide a visual warning when the layer of ice falls below a predetermined amount. Additionally, when the flooring system is used for in-line or floor hockey, forced air may be directed into the passages and through the holes to lower the friction between the projectile and the floor surface. When the flooring system is used outdoors in harsh environmental conditions for floor-based sports, a coolant can be pumped within the floor system to prolong the useful life and desired characteristics of the flooring system.

36 Claims, 12 Drawing Sheets

FLOOR SYSTEM FOR A RINK

TECHNICAL FIELD

This invention relates to a floor system for a rink, e.g., a hockey rink. More particularly, this invention relates to a floor system comprised of connected floor elements, each including a planar upper surface that can either form the playing surface for floor or in-line hockey, and supporting elements with tubular channels that can be used to freeze water above the upper surface and between the tubular channels for ice skating and hockey.

BACKGROUND OF THE INVENTION

Floor structures for forming ice rinks commonly include pipes that are buried in sand or embedded in concrete. These ice forming structures have suffered drawbacks. The pipes that are buried in sand are limited to single use application, i.e., ice only, and cannot easily be used for other applications. Pipes embedded in concrete are expensive to install and are thermally inefficient because they are frequently embedded at least one inch below the upper concrete surface to prevent cracking. Additionally, the concrete surface itself is undesirable for many applications. Moreover, for the pipes buried in sand and embedded in concrete, covering the ice surface with wood tiles to form another floor surface is not a viable option due to the cost of installtion/conversion and the associated labor required, and the lack of suitability of the wooden floor for certain applications. Water has also been known to leak through covered ice surfaces causing a risk of injuries for persons participating in sports on the covered surface. Additionally, to use the rink for in-line hockey, the wooden floor covering tiles may need to be covered by another surface more compatible for in-line hockey use, further increasing the cost of installation/conversion.

U.S. Pat. Nos. 4,979,373, 4,394,817, and 3,751,935 disclose plastic tubes connected to one another by plastic webbing or other connecting elements for supplying a coolant to create a layer of ice. More specifically, U.S. Pat. No. 4,979,373 to Huppee teaches spaced tubular elements connected by a planar base with the spaced parallel tubes connected to the base by vertical webs. U.S. Pat. No. 4,394,817 to Remillard shows spaced tubular elements connected together by web sections positioned between adjacent tubular elements at their vertical midpoint. U.S. Pat. No. 3,751,935 to MacCracken et al. teaches tubular elements coupled together at selected points along their length. However, these tubular arrangements are not adaptable for use in non-ice applications and thus must be removed or covered by a rigid structure to use the rink area for non-ice activities. Moreover, as previously described, covering the ice surface with wooden tiles may not be a viable option because of the cost and labor required to convert the ice surface to a floor.

U.S. Pat. No. 4,703,597 to Eggamar discloses a floor system with elements having a generally flat top surface and longitudinally extending fluid passages beneath the top surface for providing a coolant. The floor system can be used to freeze water to form a floor for an ice rink. Alternatively, the floor system can be used for other different kinds of activities like gymnastics, basketball and tennis. However, its use for an ice rink has significant disadvantages. First, because ice does not bond to the plastic upper surface, portions of the ice surface are susceptible to being sheared off from the upper plastic surface of the floor element. Eggemar uses parallel grooves in the upper surface of the flooring element in an attempt to reduce this problem. However, such a problem still exists, as the parallel grooves have no effect on shearing in a direction parallel to the grooves and have only a minimal effect on shearing in other directions. Moreover, Eggemar includes air pockets between adjacent fluid channels that decrease the efficiency of the floor system for use as a ice rink. Additionally, the parallel grooves used by Eggemar make the top surface unsuitable for use in some applications, e.g., an in-line hockey floor, where pucks or skate wheels may be adversely affected by the parallel grooves.

Existing surfaces for in-line skating rinks have been formed by asphalt and coated asphalt. The asphalt and coated asphalt surfaces are disadvantageous because they are extremely hard leading to many player injuries. As an alternative to the asphalt surfaces, interlocking plastic tiles having a generally planar upper surface have been used. The upper surfaces of the tiles have been textured to enable wheels from in-line skates to obtain a better grip and to decrease the friction between hockey pucks and the surface. These prior art tiles have also included holes therein to reduce the amount of contact between the hockey pucks and the floor to further decrease the total friction between hockey pucks and the surface. The tiles are typically 12 inches square. However, it is not uncommon for rinks to be 200 feet by 85 feet. Accordingly, one significant drawback of this system is the installation time and cost required to interlock over 15,000 tiles.

Additionally, in ice skating rinks, improper ice maintenance and/or improper use of the ice surface can cause the sheet of ice to become too thin. If the ice level becomes too thin, the possibility of ice shear and resulting injury to skaters significantly increases, and the risk of cutting into and damaging the floor elements from the ice resurfacing operation becomes more significant. The prior art has failed to solve this problem.

When plastic flooring systems are used outdoors in very hot environments, they are subject to changes in size, texture, hardness, and feel, and can cause the floor to buckle. These problems are magnified when the flooring system is exposed to direct sunlight, and the floor surface temperature can easily reach temperatures over 100° F. These drawbacks can make the floor system unusable.

Therefore, an improved floor system for use in a rink adaptable for use in ice, roller, and in-line skating applications, including ice, floor, in-line, and roller hockey, was needed. An improved floor system for a skating rink that enables the ice surface to resist shearing was also needed. Additionally, an improved floor system for an in-line hockey rink that significantly reduces installation time and cost was needed. A system for permitting extended use of a plastic floor system for in-line hockey and other application in hot temperatures and/or extreme direct sunlight was needed. A solution to prevent the sheet of ice in an ice rink from becoming too thin was also needed. The present invention was developed to accomplish these objectives.

SUMMARY OF THE INVENTION

It is an object of the present invention to provide a multi-purpose rink floor system which works as an ice skating rink piping system, professional in-line plastic skate flooring, and flooring for various multi-purpose non-ice events.

It is an object of the present invention to provide a more efficient and improved coolant piping and floor system to create an ice surface with enhanced strength.

It is an object of the present invention to provide an improved floor system for in-line and floor hockey. Additionally, another object of the present invention is to reduce the friction between playing projectiles and the upper floor surface to increase the speed at which the sport can be played.

It is yet an object of the present invention that facilitates the conversion of the floor system from floor-based activities to ice-based activities, and from ice-based activities to floor-based activities, and that reduces the time required for such conversions.

In another object, game playing and other indicia can easily be applied, permanently or removably, to a floor system that can be used for an ice rink or a floor-based sport.

It is yet another object of the present invention to provide an inexpensive rink floor system that reduces installation time and cost as compared to other ice and floor systems. In another object, the invention provides a process of continuous manufacturing of thermoplastic floor elements that snap together side-to-side and that is suitable for in-line skating and other sporting activities.

It is an object of the present invention to provide a thin ice warning system that provides an indication when the thickness of the sheet of ice has become too thin.

It is an additional object of the present invention to provide a plastic flooring system for outdoor sports and recreational use in hot environments and in direct sunlight, that is coupled to a coolant distribution system to prevent reduce buckling and undesirable changes in size, texture, hardness, and feel.

It is an object of the present invention to provide a playing surface in a rink having a floor element having a length and including an upper floor with a generally-planar top surface. Parallel supports vertically support the top surface above the foundation for substantially the entire length of the floor element. Channels are positioned within the parallel supports that extend substantially the entire length of the floor element. Passages are located below the top surface and between adjacent parallel supports, that extend substantially the entire length of the floor element. A plurality of holes extend through the upper floor that permit fluid communication between the passages and the region immediately above the upper surface.

Another object of the present invention to provide a playing surface above a foundation in a rink. The playing surface is provided by a plurality of floor elements. Each floor element has a length and a width and an upper floor with a generally-planar top surface. The length of each floor element is at least 10 times the width. A plurality of parallel supports are used to vertically support the upper floor above the foundation for substantially the entire length of the floor element. Channels are located within the parallel supports that extend substantially the entire length of the floor element. Passages below the upper floor and between adjacent parallel supports, extend substantially the entire length of the floor element. A plurality of holes in the upper floor fluidly connect the region immediately above the top surface with a region below the upper floor. Each of floor elements are joined to adjacent floor elements in a side-by-side relationship.

It is yet another object of the present invention to provide a playing surface for a rink having a plurality of floor elements each having a length and a width. Each floor element also includes an upper floor with a generally-planar top surface, and a plurality of tubes integrally formed with the upper floor vertically supporting the top surface for substantially the entire length of the floor element. The floor elements are oriented side-by-side with adjacent floor elements joined to each other to form a substantially continuous generally-planar top surface that extends across the floor elements.

Further objects, features and other aspects of this invention will be understood from the following detailed description of the preferred embodiments of this invention with reference to the attached drawing figures.

DESCRIPTION OF THE PREFERRED EMBODIMENTS

Figure 1:
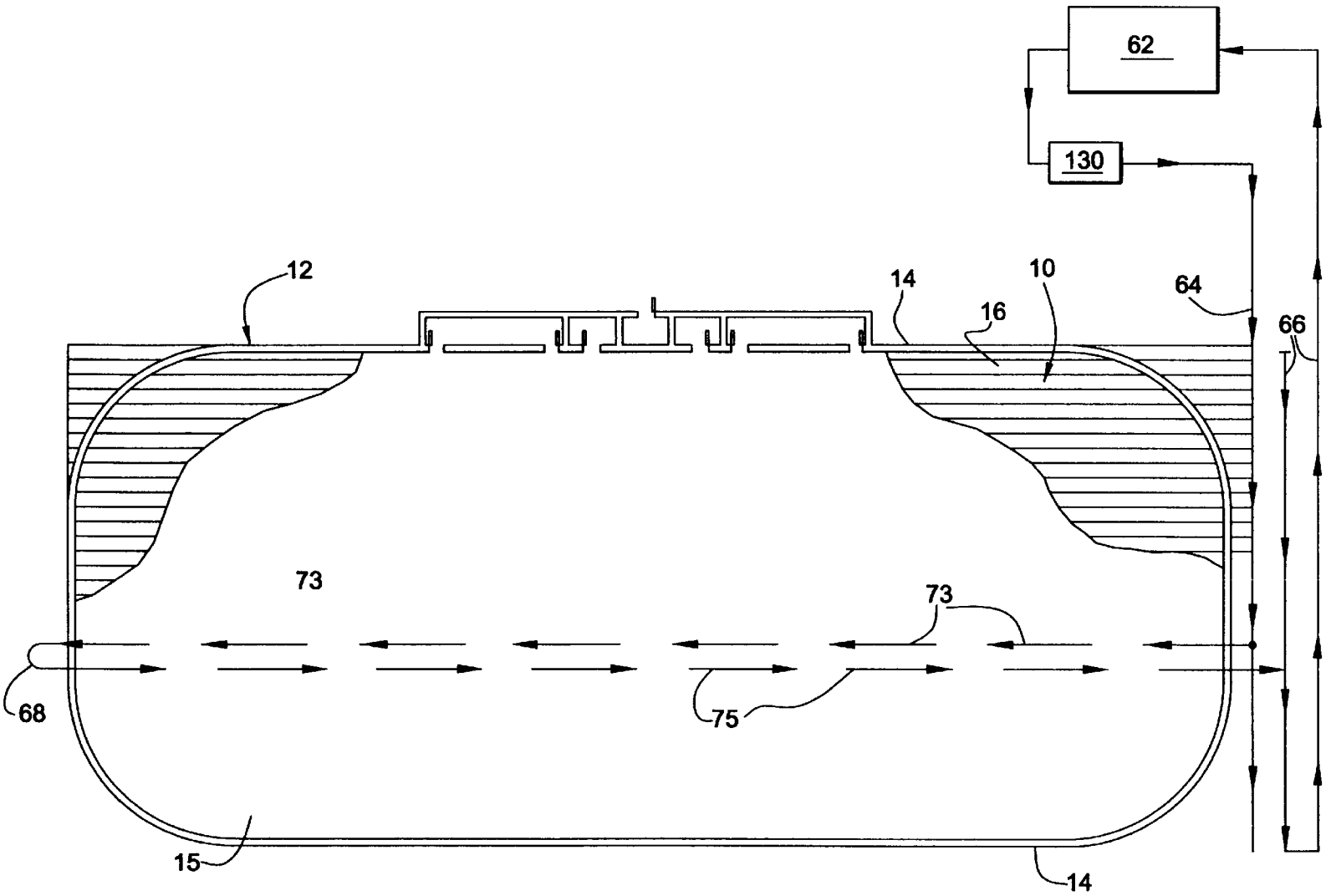
FIG. 1 is a schematic plan view of a hockey rink with the flooring system of the present invention using a return-feed type coolant distribution system.
Figure 13:
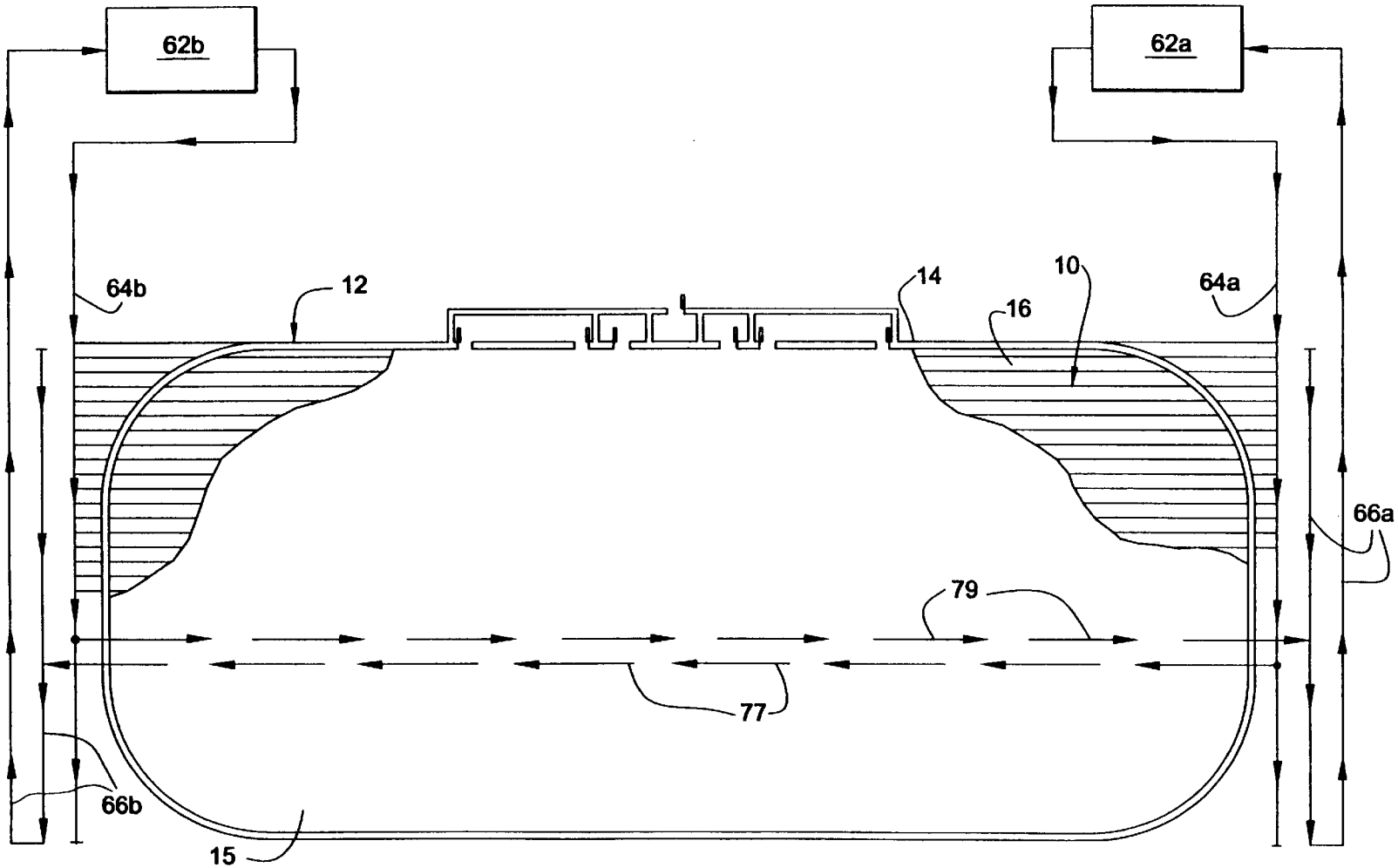
FIG. 13 is a schematic plan view of a hockey rink with the flooring system of the present invention using a cross-feed type coolant distribution system.
Figure 14:
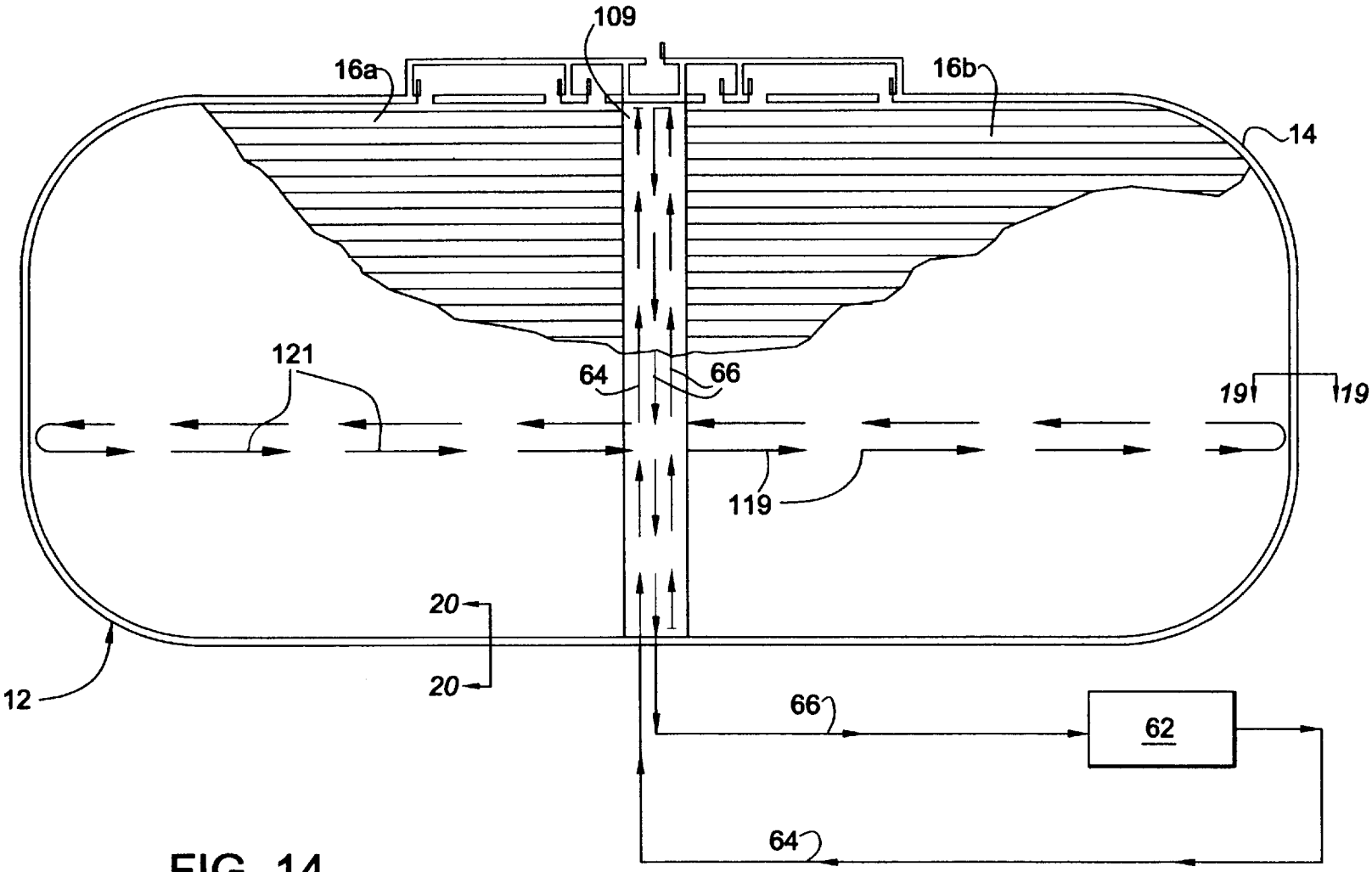
FIG. 14 is a schematic plan view of a hockey rink with the flooring system of the present invention using a coolant distribution system with a center feed header.
Figure 16:
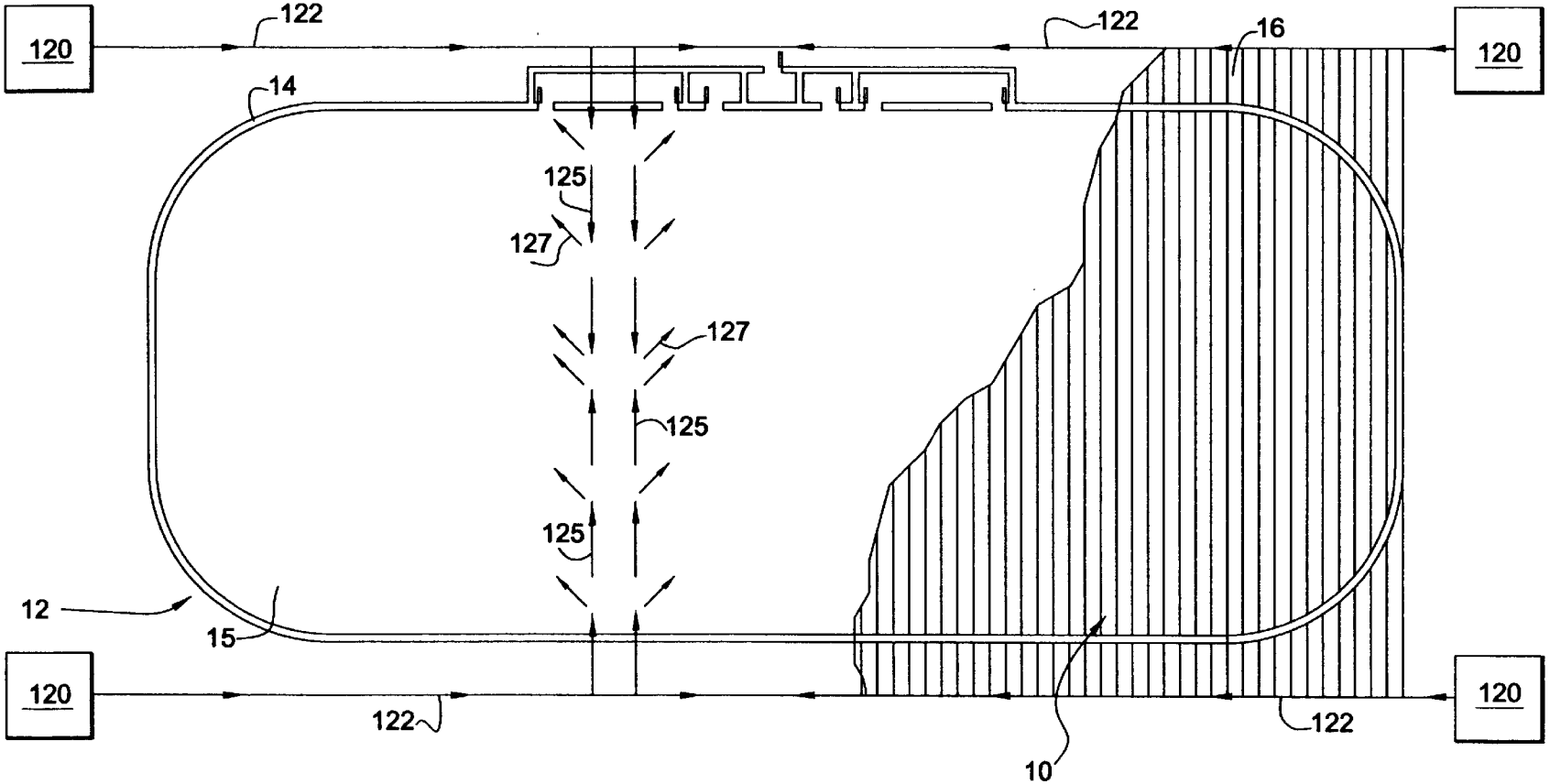
FIG. 16 is a schematic plan view of a hockey rink with flooring elements that use a forced air moving system installed laterally with respect to the rink.

Referring to the drawings wherein like numerals indicate like elements, a floor system, designated generally by reference numeral 10, is illustrated. It is noted that while floor system 10 is adaptable for many uses, it is extremely beneficial used in a rink 12 environment, as shown in FIG. 1. Accordingly, rink 12 may include a dasher board system 14 defining the periphery of the rink skating or playing surface 15. The floor system 10 for the rink 12 includes a plurality of parallel floor elements 16, each that preferably, but not necessarily, extends entirely across the rink surface 15. FIGS. 1, 13, and 14 depict the floor elements 16 extending longitudinally across the rink surface 15. Alternatively, the floor elements 16 can extend laterally across the rink surface 15, as shown in FIG. 16, or the floor elements 16 can extend in any other direction across the rink surface.

Figure 2:
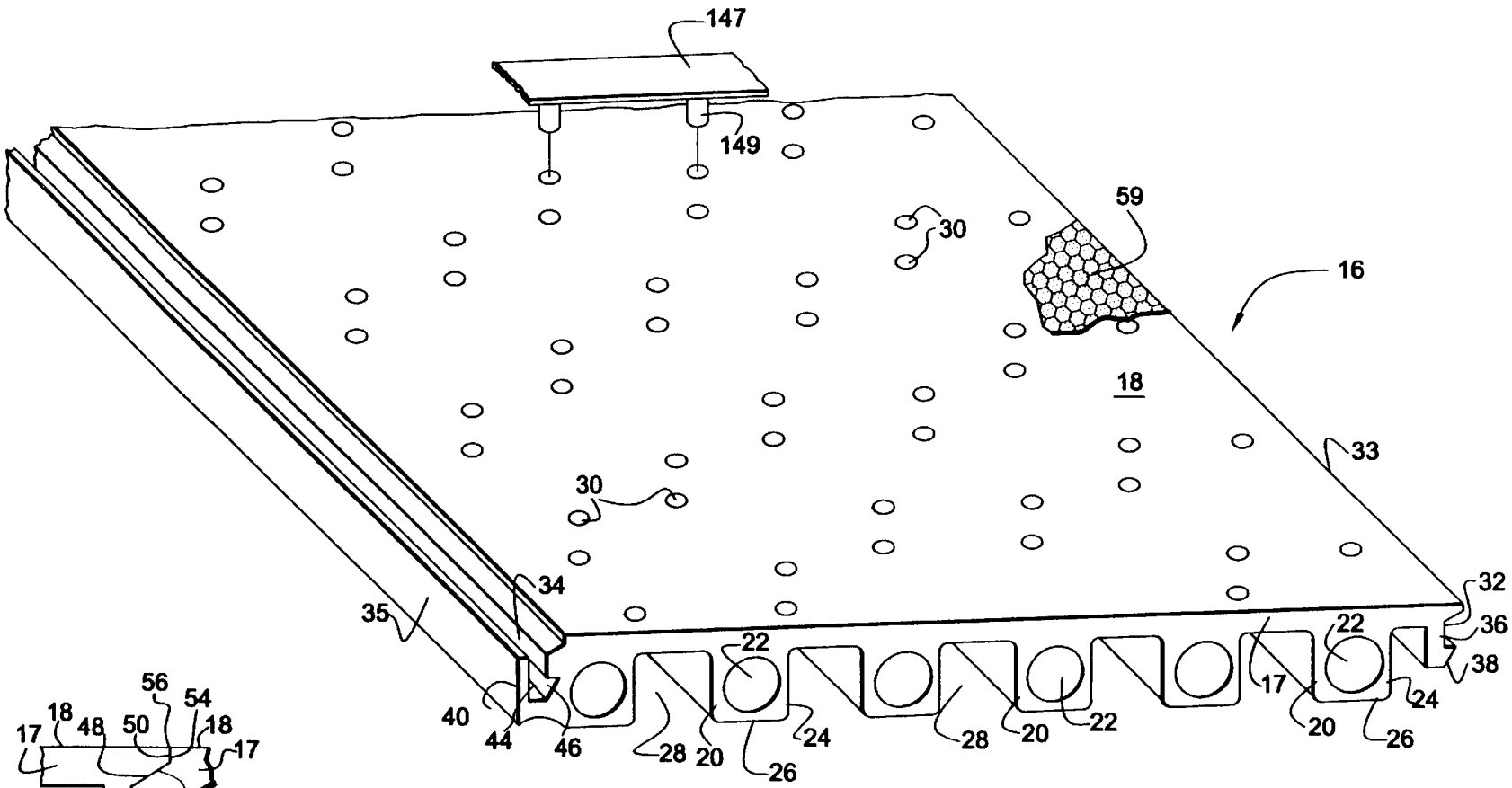
FIG. 2 is an isometric view of a floor element used in the flooring system.

As shown in FIG. 2, each floor element 16 includes an upper floor 17 and supports 20 that extend along the length of the floor elements 16. The upper floor 17 has a generally-planar top or upper surface 18 which forms a floor surface for in-line or roller skating and other general uses, and also forms a surface upon which an ice surface may be formed. The supports 20 space and support the upper floor 17 and its top planar surface 18 a vertical distance above at supporting foundation 19, e.g., a concrete slab or any other suitable arrangement such as compacted rock dust and asphalt paper. The supports 20 include channels 22 therein that function as tubes to permit fluid flow therethrough. The supports 20 include opposing vertical wall portions 24 and a horizontal floor portion 26 connecting the lower ends of the opposing vertical walls 24. The wall portions 24 and the floor portion 26 surround and structurally bound the channels 22 from the sides, and portions of the upper floor 17 superimposed above the channels 22 bound the channels 22 from above. The channels 22 are preferably cylindrical in cross section to minimize flow resistance. However, the channels 22 may be provided with any other cross-sectional shape. As described in more detail hereinafter, coolant, at a temperature below 32° F., may be pumped through the channels 22 to freeze water and create an ice surface above the top planar surface 18 for ice skating and other activities using an ice-surface, e.g., curling.

Longitudinal gaps or passages 28 are disposed below upper floor 17 and between adjacent supports 20, and therefore, the passages 28 are also disposed between adjacent channels 22. Holes 30 extend through the upper floor 17 above the passages 28 and permit fluid communication, e.g., air or water, between the passages 28 and the region immediately above the top planar surface 18 of upper floor 17. As described in more detail hereinafter, the passages 28 and the holes 30 help to provide an arrangement for an improved ice surface, and also provide the ability to enhance the playing surfaces for in-line hockey, floor hockey, and other sports.

Each floor element 16 further includes a first fastening element 32 on one lateral side 33, and a second fastening element 34, preferably shaped complimentary to the first fastening element 32, on its opposing lateral side 35. This enables the first fastening element 32 to interfit and matingly lock with the second fastening element 34 of the adjacent floor element 16 so that adjacent floor elements 16 can be joined together. This also enables the top planar surfaces 18 of the floor elements 16 to form a continuous top planar surface for the rink 12. In a preferred embodiment, the first fastening element 32 is a "male" fastening element having a projection 36 depending downward from the upper floor 17 and a locking lip 38 extending laterally outwardly from the projection 36. The second fastening element 34 is a "female" fastening element having a generally vertical flange 40 spaced from an outer wall portion 42 of the end support 20 to form a receiving slot 44 for the projection 36 of the adjacent first fastening element 32. The outer surface of the outer wall portion 42 includes a lateral groove 46 that is sized and shaped to receive the locking lip 38 of the adjacent first fastening element 32. Thus, when adjacent floor elements 16 are matingly joined, as shown in FIG. 3, the downward projection 36 and lateral locking lip 38 of the male fastening element 32 fits within the receiving slot 44 and the lateral groove 46 of the female fastening element 34 to lock the adjacent floor elements 16 together and prevent inadvertent or unintended separation between the floor elements 16.

Figure 3:
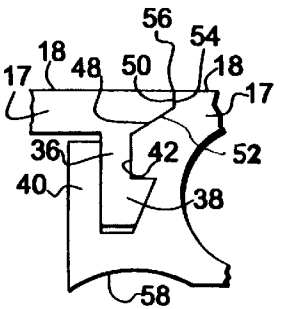
FIG. 3 is a detailed side elevational view showing the interface between adjacent floor element in an installed position.

As is also shown in FIG. 3, the lateral ends of the upper floors 17 of the adjacent floor elements 16 are preferably tapered to be complementary to each other for creating a flush and smooth continuous upper floor surface between the adjacent floor elements 16. Thus, for example, one lateral end of the upper floor 17 of floor element 16, e.g., the end 33 with the male fastening element 32, has a tapered lower surface 48 extending up to a small vertical lip 50 at its extremity. The other lateral end 35 of the floor element 16 is recessed on its bottom surface to provide a complimentary matching tapered surface 52 to surface 48 and a complimentary matched small vertical surface 54 to lip 50. Thus as illustrated in FIG. 3, the complimentary tapered surfaces 48, 50 and 52, 54 help reduce the depth of the gap of the seam 56 between the floor elements 16, and help minimize the possibility of minor tolerancing errors creating detrimental effects. Moreover, this facilitates the manufacturing process and reduces tolerancing errors because it evenly distributes the amount of extruded material so the floor elements 16 cool evenly without shrikage, cuppage, or bowing. This is especially desirable when the top planar surfaces 18 are used as the playing surface.

Additionally, the bottom surface of the female fastening element 34 preferably has a concave portion 58, e.g., an inward radiused portion. The location and existence of this concave portion 58 prevents the seam 56 between interlocked floor elements 16 from separating in the event that a large vertical force is applied in the region of the seam 56. For example, if a floor element had a flat bottom surface, a vertical downward force in the vicinity of the seam would compress that section causing the floor elements on either side to rotate upwardly into each other urging the seam to separate. However, the absence of material in the concave portion 58 in the preferred embodiment, forces the complimentary shaped surfaces 48, 50 and 52, 54 to press into each other and tighten the interlocking joint if a large vertical force is applied in the vicinity of the seam 56.

Figure 4:
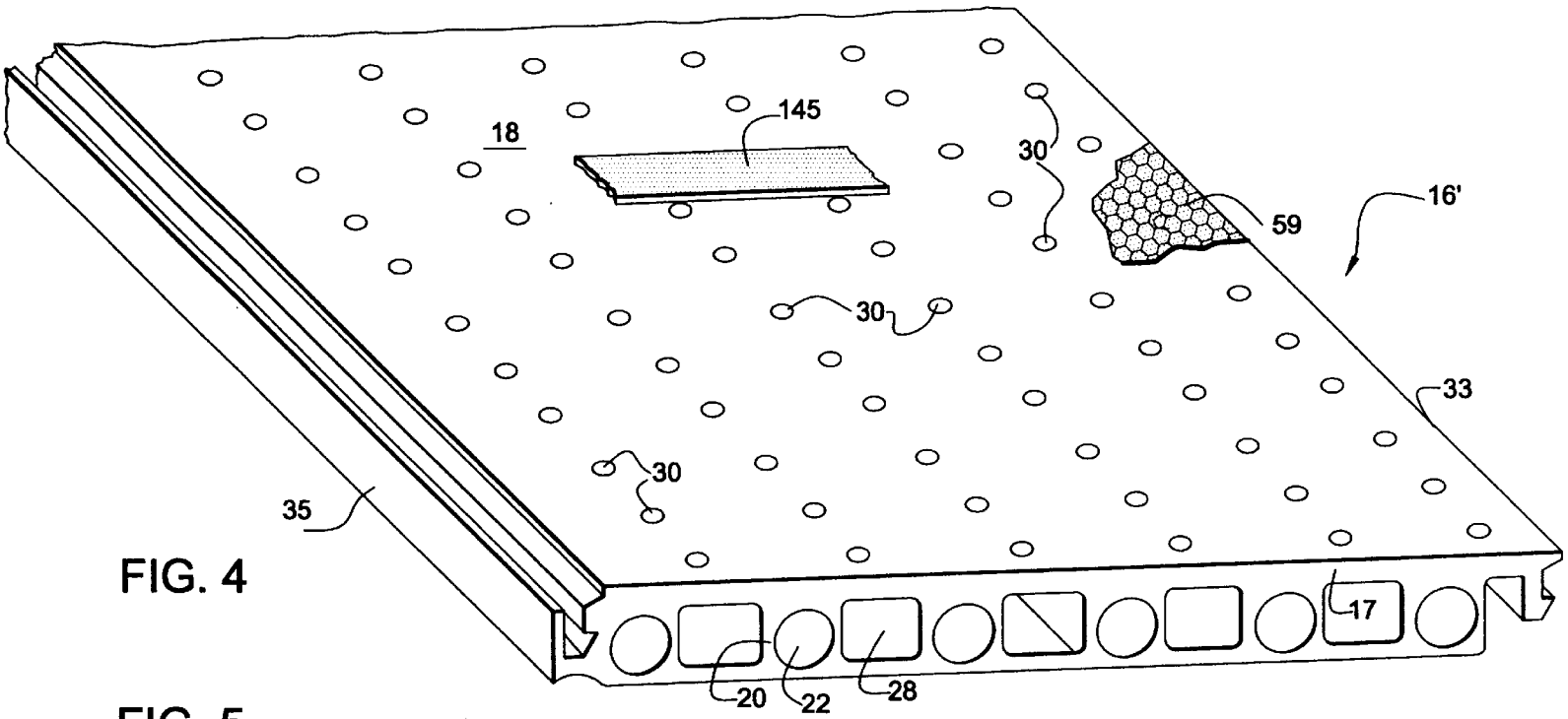
FIG. 4 is an isometric view of a modified floor element used in the flooring system.

A modified floor element 16', shown in FIG. 4, is similar to floor element 16 of FIG. 2 having a top generally planar surface 18 and supports 20, channels 22, passages 28, and holes 30. Floor element 16' differs from floor element 16 of FIG. 2 in that the gaps or passages 28 are bounded from below and the adjacent supports 20 are joined, by horizontal bottom floor portions 60. This arrangement may be preferable in certain applications if there is a likelihood of using the floor system with forced air movers for floor or in-line hockey.

Each floor element 16, 16' is preferably made from an extrusion process and is preferably made from a relatively flexible material, e.g., polyethylene or polypropylene, that enables the floor element 16 to be rolled up and shipped to the site for installation. This facilitates installation as the rolls can be easily shipped to the site of the rink and unrolled. Once a first floor element 16 is properly placed down and unrolled, a rolled second floor element 16 may be placed immediately adjacent to the first floor element 16 with a longitudinal end of its male fastening element 32 placed in the longitudinal end of the female fastening element 34 of the adjacent first floor element 16. As the second floor element 16 is unrolled, the first and second adjacent flooring units automatically interlock as the male fastening element 32 of the second floor element 16 continues to interfit within the female fastening element 34 of the first floor element 16 along its entire length.

Additionally, the floor system 10 does not need to be installed on a foundation of concrete or asphalt. Other and less expensive floor foundations, e.g., a base of crushed rock with fine particles, and sheets of Styrofoam and mineral paper, may be used.

Top generally-planar surface 18 preferably includes, but need not have, a textured finish 59. By describing the top surface 18 as being generally-planar, it is meant that the surface is generally flat having no significant changes in elevation that would significantly adversely affect the traveling of an in-line skate or a hockey playing projectile directly on the upper surface. Thus, the top surface 18 can be generally-planar and textured, and can also include holes 30 therein. Textured finishes are known in the art, as various prior art plastic flooring tiles are provided with textured upper surfaces. While only selected portions of the upper surface 18 in FIGS. 2, 4, 6, 9, and 11 are shown as having a textured finish 59, the entire upper surface 18 preferably includes a textured finish 59, and that only small portions have been shown as textured for drawing clarity. One preferred textured finish 59 is a "matte" finish that gives a sandpaper or pebbled effect. Such a textured finish 59 can be applied to the extruded floor element 16 by a heater roller or texture wheel having a mirror image of the desired texture, preferably after the extrusion has cooled. The textured finish 59 enables wheels from in-line skates and persons walking or running on the surface 18 to obtain better traction, and the textured finish decreases friction between hockey pucks and the floor surface 18. This system of applying texturing to the top side of the extrusion permits the floor elements 16 to have the desired textured surface to accommodate the user's requirements for the given sporting event for which the product will be used, and such can be accomplished by selecting a desired one of a number of heated texture wheels having the mirror image of the desired texture.

Figure 8:
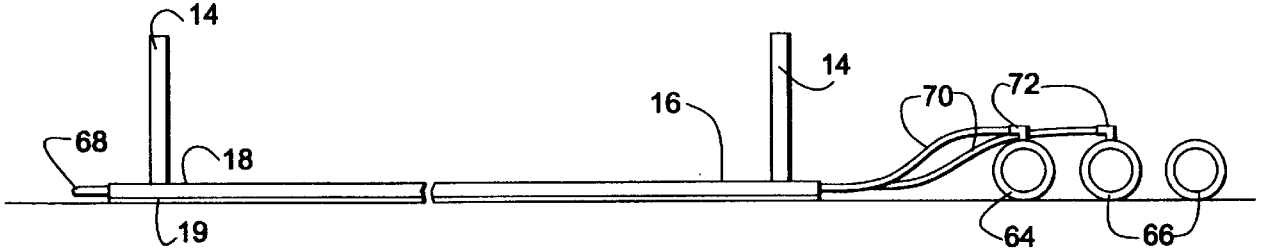
FIG. 8 is a cross-sectional view of the coolant distribution system.
Figure 10:
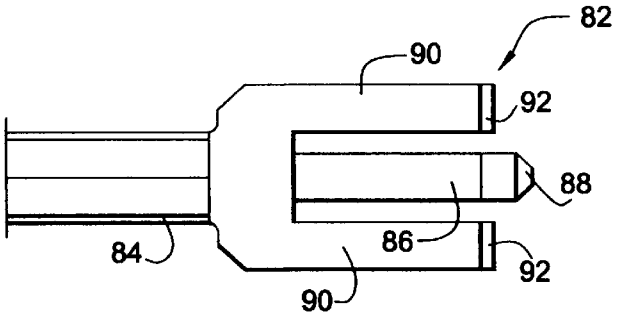
FIG. 10 is a top plan view of a boring tool used for forming integral tubular channel extensions.
Figure 9:
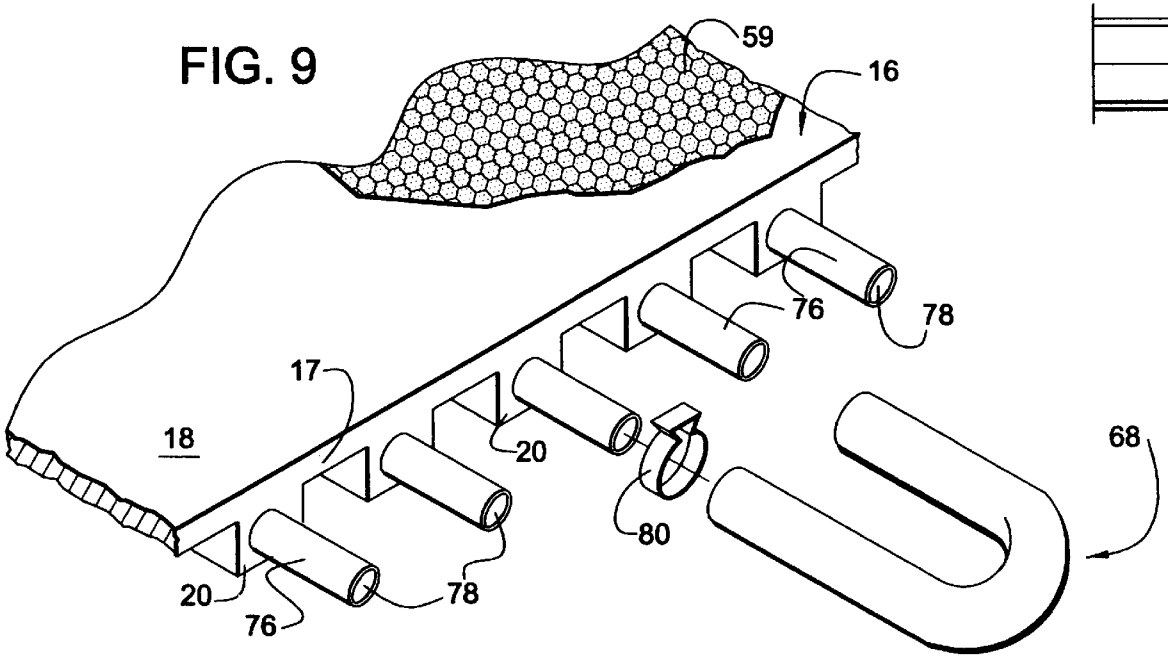
FIG. 9 is an exploded isometric view of the end of the coolant distribution system including U-shaped tubular return elements.

Referring to FIGS. 1, 8, and 9, the interlocked floor elements 16 forming the floor system 10 are coupled to a coolant distribution system to permit the formation of an ice surface for ice skating and other ice-surfaced events. The coolant distribution system includes a refrigeration and pump unit 62, a supply header 64 supplying coolant from the refrigeration and pump unit 62 to the floor elements 16, and a return header 66 returning coolant from the floor elements 16 to the refrigeration and pump unit 62. As the embodiment of FIG. 1 is a return-feed type coolant distribution system, flexible U-shaped fluid return elements 68 are used at the ends of the channels 22 of the floor elements 16, opposite the headers 64 and 66, so the coolant traveling in each of every other channel 22 changes directions and travels back toward the headers in a respective adjacent channel 22. To complete the flow system, flexible tubing 70 fluidly connects every other channel 22 and the supply header 64 and the adjacent channels to the return header 66. The tubing 70 is connected to the headers 64 and 66 via 90° fittings 72. It should be noted that the refrigeration and pump unit 62 includes at least a refrigeration unit and a pump. However, the refrigeration unit and the pump need not be within a common housing, and separated devices performing these functions could be used.

The flow in the return header 66 initially extends in the same direction as in the supply header 64. When the return header 66 reaches the end of the supply header 64, it changes direction and flow back to the refrigeration and pump unit 62. This arrangement is what is known as a reverse return header distribution system and it equalizes the pressure distribution along the length of the header 66.

In operation, a pressurized coolant, e.g., antifreeze, is provided at a temperature below 32° F. from the refrigeration and pump unit 62 to the supply header 64. The coolant flows from the supply header 64 to alternate or every other channel 22 along the joined floor elements 16 via the 90° fittings 72 and the flexible tubing 70. The coolant then travels in the direction of arrows 73 from the longitudinal end of the floor elements 16 adjacent the headers to the longitudinal end of the floor elements 16 opposite the headers. At this end, the coolant changes direction 180° by traveling from these channels 22 through the U-shaped fluid return elements 68, and into each alternate channel 22 in the direction of arrows 75. At the end of the floor elements 16 adjacent the headers, the returned coolant exits the floor elements 16 and travels into the return header 66. The coolant then returns to the refrigeration and pump unit 62, whereupon it is cooled and pumped through the system again.

To connect the U-shaped fluid returns 68 and the flexible tubes 70 to the ends of the floor elements 16, tubular longitudinal extensions 76 extend longitudinally outward from the longitudinal ends of the floor elements 16. As shown in FIG. 9, the longitudinal extensions 76 are formed integrally with the floor element 16 and are hollow so that the hollow portion 78 of the longitudinal extensions 76 are in fluid communication with the channels 22 of the supports 20. The outer and inner diameters of the longitudinal extensions 76 are preferably circular to facilitate mating with the U-shaped fluid returns 68 and the flexible tubes 70, and to minimize flow resistance between the hollow portions 78 and the channels 22, respectively. To further facilitate mating between the longitudinal extensions 76 and the U-shaped fluid returns 68 and the flexible tubes 70, the U-shaped fluid returns 68 and the flexible tubes 70 each have a diameter slightly greater than the outer diameter of the longitudinal extensions 76. Accordingly, the U-shaped returns 68 and the flexible tubes 70 are inserted over the ends of the longitudinal channel extensions 76. A hose clamp 80 may be used at each connection to ensure that the connections between the coolant carrying elements remain fit.

The integrally formed longitudinal extensions 78 are preferably formed by taking an extruded floor element 16 and cutting away all portions other than the material of the longitudinal extensions 78 from the longitudinal end of the extruded floor section 16. This is preferably accomplished by using an extension forming tool 82 that can be used with common drills. The extension forming tool 82 has a shank 84 that fits into standard drills like a drill bit. The tool 82 also includes a central guide shaft 86 that is collinear with the shank 84 and has a tapered nose 88 its forward end opposite the shank 84. The tool 82 also includes a pair of arms 90 positioned radially outward from the guide shaft 86. The forward end of each arm 90 includes a cutting tip 92 made from a material, e.g., a hardened carbon steel, that can effectively cut the plastic material of the floor element 16. In an alternative arrangement, a plurality of tools 82 can be coupled to a common guide block with a gearing system such that a single drive can simultaneously rotate a number of tools 82 for the simultaneous formation of a like number of longitudinal extensions 78.

To form the longitudinal extensions 76, the shank 84 of the extension forming tool 82 is inserted in a suitable drill chuck. At one longitudinal end of a floor element 16, the tapered nose 88 of the central guide shaft 86 is inserted into a first channel 22. The drill is activated to rotate the tool 82. As the tool 82 rotates, its cutting tips 92 cut away at the material from the end of the floor element 16 within the distance between the two arms 90, except for the material in the wall of the longitudinal extension 76. The central guide shaft 86 is advanced within the channel 22 until a desired extension length is obtained, or until the rear end of the shaft 86 reaches the front end of the longitudinal extension 76, which could itself set the desired extension length. This completes the formation of the first extension. This process is repeated to form each extension 76 on both longitudinal ends of each floor element 16. One major advantage produced by this tool 82 is the ability to form the longitudinal extensions 76 inexpensively and at the site of installation. As the floor elements 16 may also be cut to length in the field by any suitable cutting device, e.g., a circular saw or a jigsaw, the floor elements 16 do not need to be supplied to any tight tolerances by the factory. Indeed, the floor elements 16 may be supplied in large spools by the factory and shipped to the desired floor location to be unrolled and cut. The size of the spools are limited solely by shipping and handling constraints.

FIG. 13 shows a coolant distribution system that uses a cross flow principle in lieu of the return-feed principle of FIG. 1. It primarily differs from FIG. 1 by including a supply header 64*a*/64*b* and a return header 66*a*/66*b* at both longitudinal ends of the floor elements 16. In this embodiment, no U-shaped fluid return elements are used. Instead, each channel 22 is coupled, via a flexible tube 70, to a supply header 64*a*/64*b* at one end and a return header 66*a*/66*b* at the other end. In a preferred arrangement, alternate channels 22 are coupled at one end for fluid communication with the adjacent supply header, e.g., 64*a*, while the remaining alternate channels 22 at that same end are coupled for fluid communication with the adjacent return header, e.g., 66*a*.

In operation, the pressurized coolant is supplied to both supply headers 64*a*/64*b* by one or more refrigeration and pump units 62*a*/62*b*. The coolant supplied to supply header 64*a* from refrigeration and pump unit 62*a* enters alternate channels 22 at the end of the floor elements 16 adjacent that supply header 64*a*. The coolant travels within the channel 22 along the length of the floor element 16 in the direction of arrow 77. When the coolant reaches the other end of the channel 22, it enters the return header 66*b* whereupon it flows into the refrigeration and pump unit 62*b* associated with that return header 66*b*. Simultaneously, the coolant supplied to supply header 64*b* from refrigeration and pump unit 62*b* enters the channels 22 at the end of the floor elements 16 adjacent that supply header 64*b* that are not being supplied with coolant from its opposite end. The coolant travels within the channel 22 along the length of the floor element 16 in the direction of arrow 79. When the coolant reaches the other end of the channel 22, it enters the return header 66*a* whereupon it flows into the refrigeration and pump unit 62*a* associated with that return header 66*a*.

Figure 15:
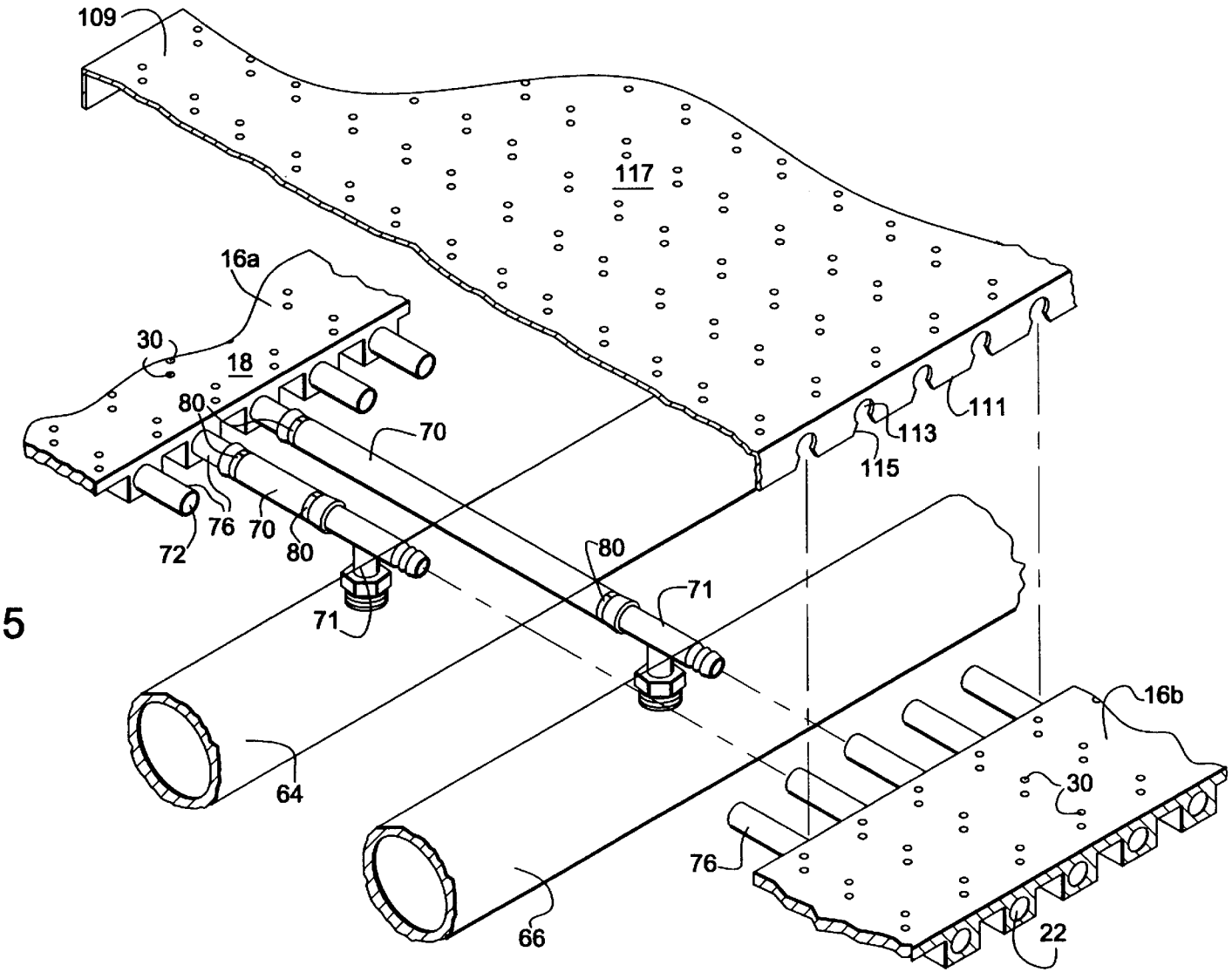
FIG. 15 is an exploded perspective view of the center region of the coolant distribution system of FIG. 14.

FIGS. 14 and 15 show a coolant distribution system that uses a center feed principle in lieu of the arrangements shown in FIGS. 1 and 13. It primarily differs from FIGS. 1 and 13 by including a supply header 64 and a return header 66 that extend across the rink 12 between the ends, but are preferably centered with respect to the rink 12. The headers 64 and 66 may extend laterally across the rink 12, as shown, or may extend longitudinally across the rink 12, not shown. Additionally, in this arrangement, each floor element does not extend entirely across the playing surface, but extends from one end of the rink to a location adjacent the headers 64 and 66. Thus, floor elements 16*a* and 16*b* are provided on both sides of the headers 64 and 66.

As shown in FIG. 15, alternate channels 22 of both floor element 16*a* and 16*b* are coupled at their inner end for fluid communication with the adjacent supply header 64, while the remaining alternate channels 22 at that same inner end are coupled for fluid communication with the return header 66. The channels 22 are preferably connected to the headers 64 and 66 by utilizing tubular extensions 76 that extend longitudinally outward from the longitudinal ends of the floor elements 16, and connecting flexible tubes 70 between the extensions 76 and tees 71 that are mounted to the headers 64 and 66. The opposing or outer ends of the floor elements 16*a* and 16*b* utilize U-shaped fluid returns 68 in a manner as previously described. A hose clamp 80 may be used at each connection to ensure that the connections between the coolant carrying elements remain fit.

Figure 20:
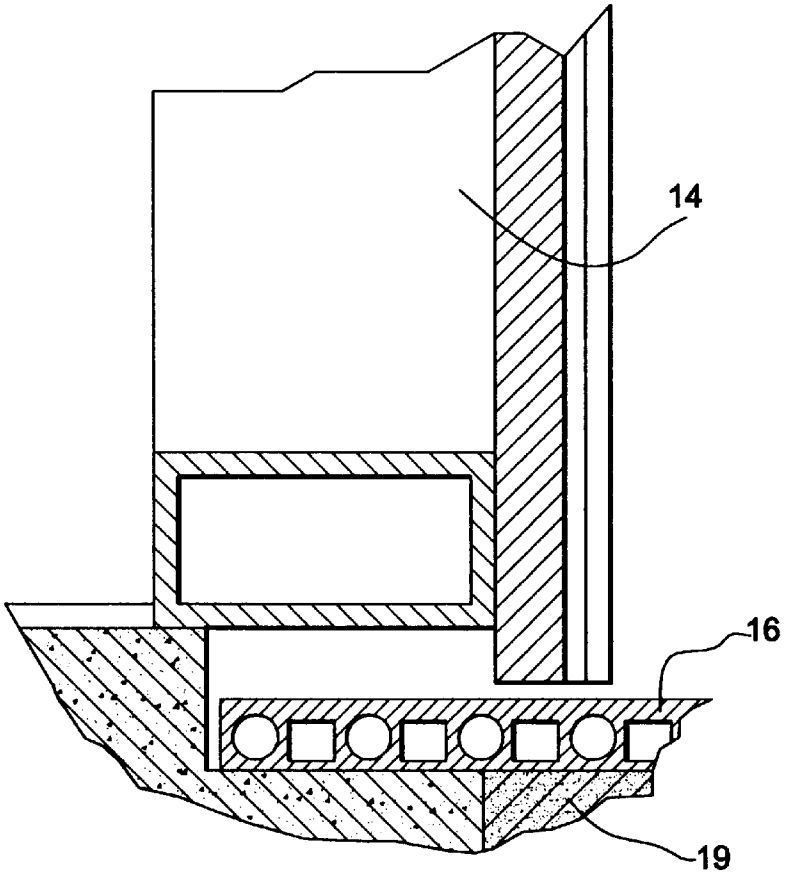
FIG. 20 is a cross sectional view taken through line 20—20 of FIG. 14.
Figure 19:
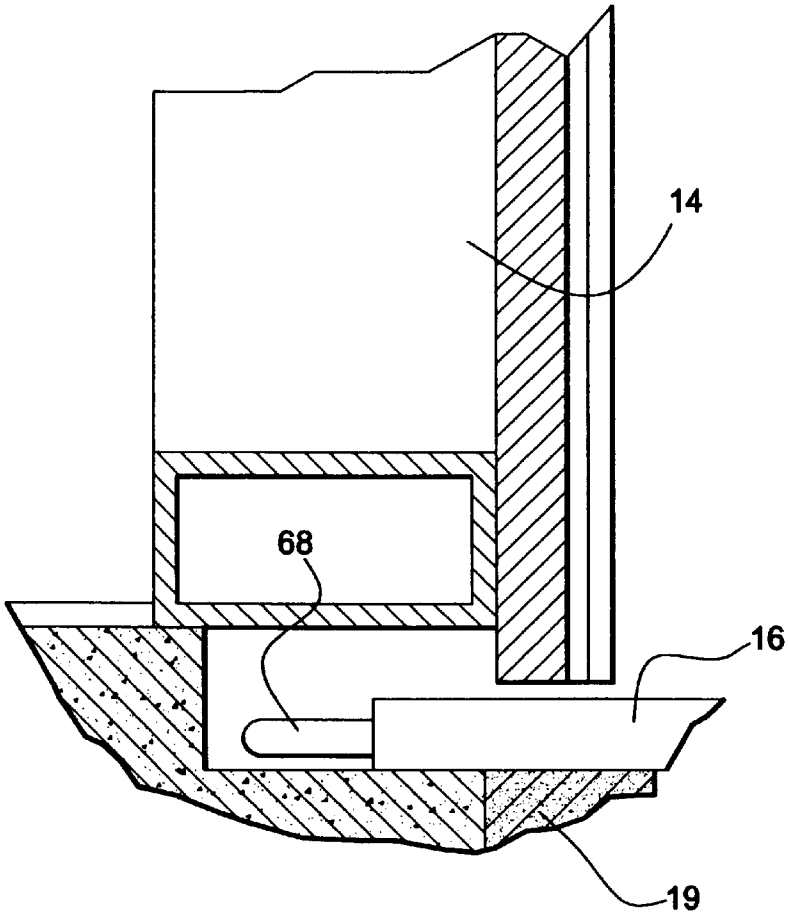
FIG. 19 is a cross sectional view taken through line 19—19 of FIG. 14.

The small gap between the inner ends of the floor elements 16*a* and 16*b* is preferably bridged by a cover element 109 made from the same material, and having the same texturing as, the adjacent floor elements 16*a* and 16*b*. The cover element 109 has downwardly depending flanges 111 having a series of circular holes 113 and guide slots 115 therein. Each hole 113 and guide slot 115 corresponds to a respective tubular extension 76 and the holes 113 are sized to be slightly larger than the outer diameter of the extensions 76. This arrangement permits the cover element 109 to snap over the top of the tubular extensions 76 so that the top surface 117 of the cover element 109 forms a continuous upper floor surface with the top planar surfaces 18 of the floor elements 16*a* and 16*b*. In this arrangement, as shown in FIGS. 19 and 20, the outside longitudinal and lateral ends of the floor elements 16 terminate at or below the dasher boards 14. The dasher boards 14 are cantilevered over the ends of the floor elements 16 and the tubular extensions 76 and U-shaped fluid returns 68, so the entire floor and cooling system, not including a portion of the headers 64 and 66 and the cooling and pump units 62, is maintained within the rink area, i.e., within the outer perimeter of the dasher board system 14. This allows for expansion and contraction of the flooring elements 16 while simultaneously concealing the fluid connection elements. It is also noted that while FIGS. 1 and 13 depict the ends of the floor elements 16 extending outside the perimeter of the dasher board system 14, it is within the scope of the invention to have these ends terminate within the dasher board system 14 as well.

In operation, the pressurized coolant is supplied to the supply header 64 by a refrigeration and pump unit 62. The coolant supplied to supply header 64 from refrigeration and pump unit 62 enters alternate channels 22 at the inner end of both floor elements 16*a* and 16*b*. The coolant travels within those channels 22 along the length of the floor elements 16*a* and 16*b* in the directions of arrows 119. When the coolant reaches the outer ends of the channels 22, it changes direction 180° by traveling through the U-shaped fluid return elements 68, and into each alternate channel 22 in the directions of arrows 121. When the coolant reaches the inner ends of the floor elements 16*a* and 16*b*, it flows into the return header 66, whereupon it flows into the refrigeration and pump unit 62 to be cooled and repumped through the system. In a preferred arrangement, as shown in FIG. 14, a reverse return header distribution system may be used to equalize the pressure distribution along the length of the return header 66 as previously described.

Figure 11:
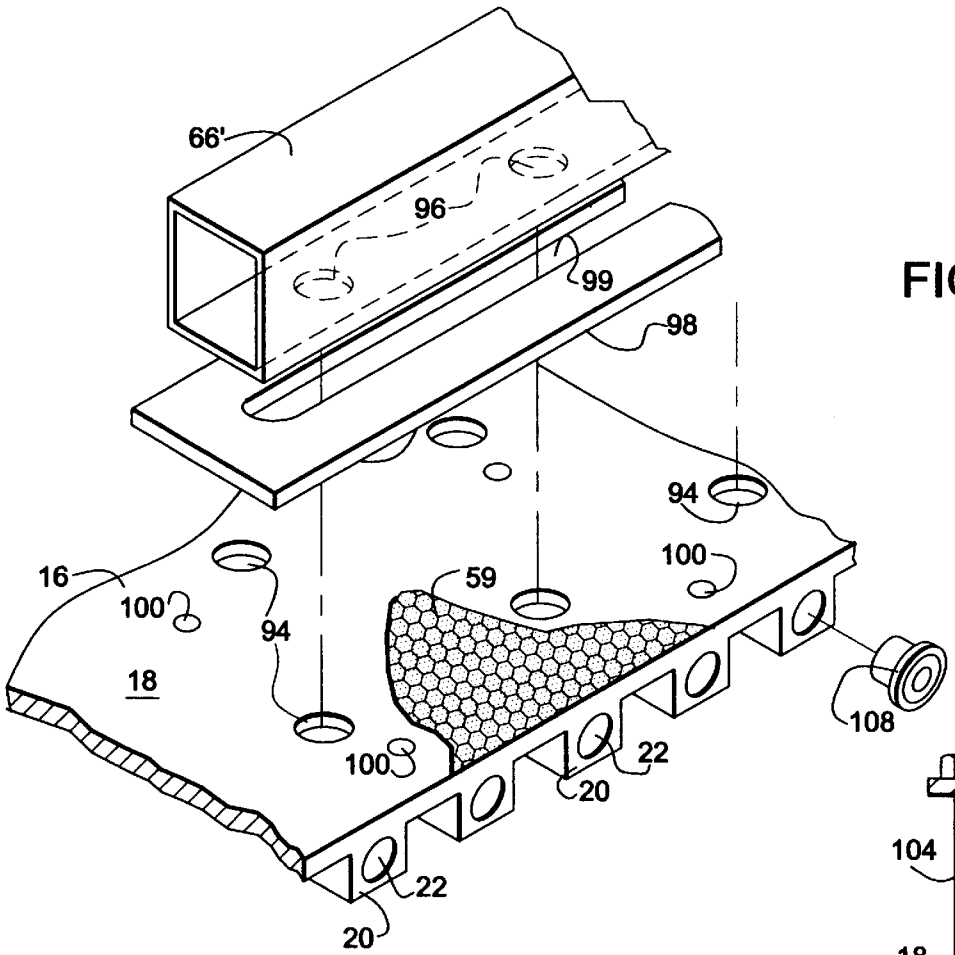
FIG. 11 is an exploded isometric assembly view showing an alternative header design for the coolant distribution system.
Figure 12:
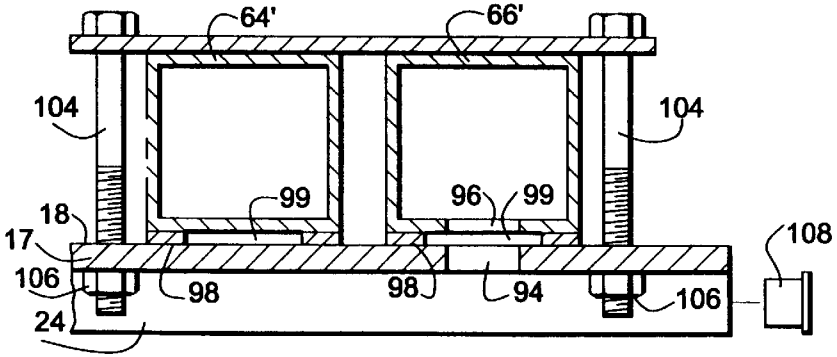
FIG. 12 is a side cross-sectional view of FIG. 11.

An alternate header system embodiment is shown in FIGS. 11 and 12. In lieu of attaching flexible tubes and/or U-shaped fluid returns to the tubular extensions, the headers 64' and 66' are attached on the upper planar surface 18 of upper floor 17. Accordingly, instead of the headers 64' and 66' being directly coupled to the extreme longitudinal ends of the channels 22 via flexible tubes, the channels 22 fluidly communicate with the headers 64' and 66' via fluid communication holes 94 in the upper floor 17 of the floor element 16 immediately above the channels 22, and fluid communication holes 96 on the bottom of the headers 64' and 66'. FIG. 11 illustrates this relative positioning between a return header 66' and a floor element 16, with the adjacent supply header removed from the figure for clarity.

Gaskets 98, each a having centrally located slot 99 therein, are placed between the bottom of the headers 64' and 66' and the top planar surface 18 of upper floor 17 to ensure a fluid-tight connection between the headers 64' and 66' and the channels 22. The gaskets 98 are preferably made from any conventional water-resistant compressible material, such as those used for pipe fittings, e.g., neoprene, felt, or rubber.

To attach the headers 64' and 66' to the floor elements 16, the floor elements 16 are provided with vertical mounting holes 100. A top securing plate 102, also having vertical mounting holes (not shown) therein, is positioned on the top of the headers 64' and 66'. Bolts 104 extend through the mounting holes in the top securing plate 102, and the mounting holes 100 in the floor element 16. Each bolt 104 is secured and tightened by a respective nut 106. Tightening this mounting hardware pulls the top securing plate 102 downward into the headers 64' and 66', which in turn, causes the gaskets 98 to compress between the bottom of the headers 64' and 66' and the top planar surface 18. This creates a water tight connection between each header 64' and 66' and the channels 22 that each header is fluidly connected thereto. With this arrangement, the ends of the channels 22 are sealed by plugs 108 or another suitable device, to ensure that the circulation of the coolant distribution system remains closed.

Regardless of the specific coolant distribution system type chosen or the type of headers chosen, the coolant distribution system permits formation of a sheet of ice above the top planar surface 18 by using the floor as a heat transfer surface. However, as described below, the floor system may be used to provide a supporting floor for other activities in addition to, or in lieu of, activities requiring a sheet of ice. The refrigeration and pump unit(s) 62 are turned on so that coolant below the freezing temperature water is circulated through the channels 22. Water is sprayed on the upper floor 17 so that the water passes through the holes 30 and fills the passages 28. As the ice is preferably formed in fine layers, the spraying of water may be done in small amounts, i.e., periodically interrupted, to permit a fine layer of ice to freeze before additional water is sprayed thereon. Either only a small amount of water or no water will flow out of the longitudinal ends of the passages 28 because the temperature of the coolant causes the small amount of water to freeze rapidly. The water freezes rapidly in part due to the close proximity between the channels 22, i.e., the pipes, and the passages 28 and the ice surface. Optionally, the ends of the passages 28 may be plugged by any conventional manner. When the water level above the top planar surface 18 reaches the desired ice thickness, the spraying of water is stopped.

Figure 5:
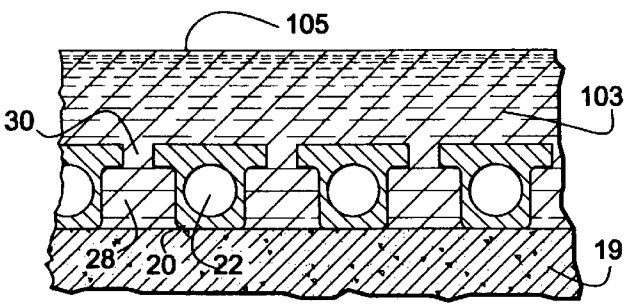
FIG. 5 is a lateral cross-sectional view of the flooring system used for an ice rink.

As coolant below 32° F. is being pumped through the channels 22 by the refrigeration and pump unit(s) 62, the water in the passages 28, in the holes 30, and above the top surface 18 remains frozen, as shown in FIG. 5, to form an upper thickness of ice 103 with an upper playing surface 105. The continuity of ice between the passages 28 and the ice above the top surface 18 through the holes 30, strengthens the ice and effectively provides resistance to ice shear. In essence, it forms ice spikes between the passages 28 and the upper thickness of ice 103 to strengthen the ice above the top surface 18 and make it resistant to shearing. This is advantageous as the ice does not bond with plastic. Moreover, the thickness of the ice can be reduced from the thicknesses that are usually used, as there is no need to use thicker ice for the purpose of reducing shear. To maximize this resistance to shear, an aggressive pattern of holes 30 is preferably used.

The preferred width for the floor elements 16 is between 6–12 inches, with the supports 20 having a preferred width of 0.5 inches, and being spaced apart 1 inch from center to center. As the length of the floor elements 16 extend across the length or width of the rink's playing surface 15, the preferred length of the floor elements 16 is approximately the distance across the rink 12, i.e., 85 or 200 feet. Thus, the length of floor elements 16 is approximately 85 to 400 times the width. Within the supports 20, the channels 22 have a preferred diameter of 0.125 to 0.375 inches. Along the length of the floor element 16 and above each passage 28, the origins of the holes 30 may be aligned, as shown in FIG. 4, or the origins of the holes 30 may be staggered, as shown in FIG. 2. If aligned holes 30 are used and the supports 20 are laterally spaced as described above, a preferred hole arrangement would include holes 30 having a diameter between 0.375–0.5 inches with the holes 30 longitudinally spaced 1.0 inch center-to-center. If staggered holes 30 are used and the supports 20 are laterally spaced as described above, a preferred hole arrangement would include holes 30 having a diameter within the range between 0.125–0.375 inches with the holes 30 spaced 0.5 inches center-to-center. The holes 30 are positioned and sized to maximize the superimposed width of the passages 28 without extending into the channels 22, and preferably without extending into the support walls 24. The holes 30 located over the reduced-width passage adjacent the fastening element 32 may be varied in size and/or spacing with respect to the other holes 30 due to the reduced width of this end passage. The staggered hole arrangement of FIG. 2 provides an additional advantage of minimizing ice cracks along a straight line.

Figure 7:
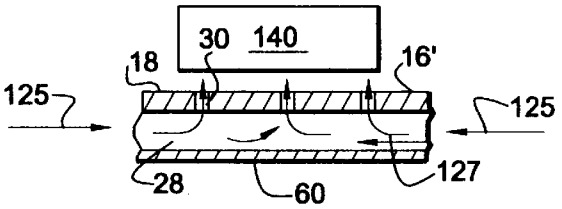
FIG. 7 is a longitudinal cross-sectional view of FIG. 6.
Figure 6:
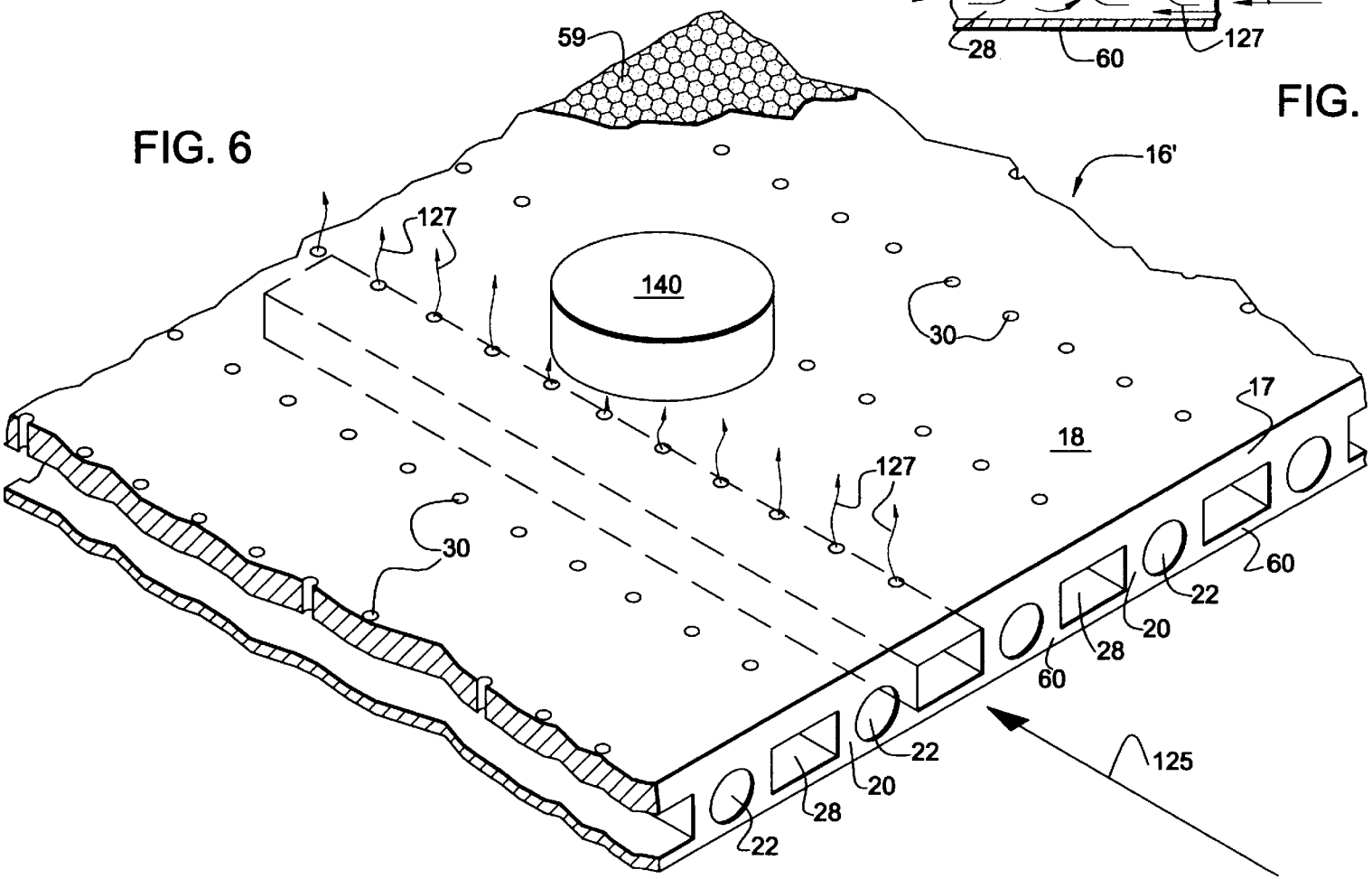
FIG. 6 is perspective view of the flooring system used for an in-line or floor hockey rink.

As previously described, the top planar surface 18 is specifically textured 59 to facilitate in-line skating, floor hockey, and other activities. If the rink is being used for in-line or floor hockey and it is desirable to further assist the gliding of the hockey puck 140 or other projectile used, forced air can be applied by forced air movers 120 to reduce the friction between the puck 140 and the floor surface 18. As shown in FIGS. 6, 7 and 16, the forced air travels from forced air movers 120, through headers 122, and into the passages 28 in the direction of arrow 125. The forced air continues to flow through the passages 28 and up through the holes 30 in the direction of arrows 127 to provide small jets of air through the upper floor 17. Depending upon the desired intensity of the airflow through the holes 30, the airflow may be sufficient to lift the puck 140 from the upper surface 18. However, a smaller airflow that does not entirely lift the puck 140 from the surface 18 may be used. In a manner similar to an air hockey game, this reduces the friction between a puck 140 and the top surface 18, which in turn, increases the speed at which the game can be played. The holes 30 also minimize the friction between the puck 140 and the upper surface 18 by reducing the surface contact area therebetween. Regardless of whether a forced air system is used, the holes 30 permit drainage of water and other liquids into the passages 28 for evaporation without affecting the playing surface, instead of remaining on the top of the floor surface 18. This is extremely useful when the rink is outdoors and uncovered.

If a forced air system is used, it may be desirable to add one or more drain valves, not shown, to aid in drainage. If there is a buildup of water in the passages 28, the valves could be opened and the forced air system turned on to force the water out the valves.

The forced air system can be used with the coolant distribution system, although the systems would not be operated simultaneously. It should be noted that if the desired applications exclude ice surface activities, the holes 30 could be placed through the upper floor 17 above the channels 22, in lieu of, or in addition to, over the passages 28. In such an arrangement, the forced air headers 122 could be connected to the longitudinal extensions. It should also be noted that while FIG. 16 depicts the distribution of air to occur from the rink's periphery, the forced air movers 120 could be coupled to the channels or passages inside the rink in a manner similar to the fluid connections shown in FIG. 14.

In operation, once the flooring elements 16 or 16' are installed and interlocked, the channels 22 may be attached to a coolant distribution system in any desired arrangement and/or the passages 28 may be attached to a forced air supply system in any desired arrangement. If the operator chooses to use the rink 12 for ice skating, coolant is pumped through the channels 22 below the freezing temperature of water. Small amounts of water are repeatedly sprayed onto the top of top planar surface 18 of the floor elements 16, 16'. Water will enter through the holes 30 and fill the passages 28, freezing in layers. This process will continue until ice begins to form above the top surface 18. The operator will terminate the supply of water when the water level above the top planar surface 18 reaches the desired ice thickness. The coolant continues to be pumped through the channels 22 to ensure that the water in the passages 28, in the holes 30, and above the top planar surface 18 remains frozen.

To convert the ice surface for floor or in-line hockey, or another floor-based activity, the ice may be melted, either gradually by stopping the operation of the coolant distribution system, or rapidly by pumping a heated fluid through the channels 22. This accelerated melting of the ice can be achieved by placing a fluid heater 130 in series with the refrigeration and pump unit 62, such as shown in FIG. 1. A control system may be coupled to the refrigeration unit and the heater so that only one may be operated at a given time.

Water from the melted ice runs out of the ends of the passages 28 and may be drained away from the rink by a drain system typically placed near the ends of the rink. Small amounts of water remaining the passages 28 will evaporate. The floor system 10 may then be used for any floor based activity. If desired, the forced air system may be coupled to the floor system 10 to enhance the play of hockey on the floor. To convert back to ice, the coolant distribution system is reactivated and water is resprayed on top of the floor in layers. Thus, converting the floor system between ice-surface activities and floor surface activities, including floor surface activities aided by forced air flow through the floor, is fast and easy, as it merely requires draining and refilling.

Figure 17:
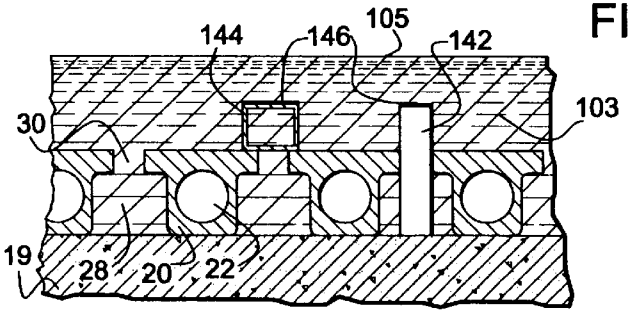
FIG. 17 is a lateral cross-sectional view of the flooring system used for an ice rink, similar to FIG. 5, implementing a thin ice warning system.

A thin ice warning system, such as shown in FIG. 17, can be used when it is desired to form a sheet of ice and it is important to ensure that the sheet of ice doesn't become too thin. The thin ice warning system includes indicators that preferably take the form of rods 142 and/or blocks 144. These indicators are positioned across the floor, preferably, but not necessarily, in a uniformed pattern. The indicators are also frozen within at least the upper sheet of the ice 103 so that the ice surrounds each indicator from all sides. If rods 142 are used for the indicators, they are preferably sized so that they may be placed through the holes 30 in the upper floor 17. If blocks 144 are used, they are placed on the top planar surface 18.

The indicators are a very visible color, e.g., florescent green or orange, so they can easily be seen by visible inspection in the sheet of ice. At least the top portion of the indicators are dipped, coated, painted, or otherwise covered by a thin layer 146 having a color different from the very visible color, preferably a color that matches the floor elements 16 and/or the ice, as the ice may be painted. This camouflages the indicators when the ice is maintained at proper thickness, e.g., ¾ inch or more.

The top portions of the indicators 142, 144 extend above the top planar surface 18 by an amount approximately equal to the level at which it is desirable to know when the ice thickness has reached a predetermined thickness. For example, if it is important to know when the ice thickness falls below ½ inch, then the top of the indicators will extend approximately ½ inch above the top surface 18 of the flooring elements 16. Should improper ice maintenance or any other cause create a condition where the ice level becomes too thin in any portion of the playing surface, the ice resurfacing machine would first cut through these indicators removing layer 146 and exposing the highly visible inside color as a warning to the operator that there is thin ice. The operator can then increase the ice thickness accordingly by applying additional water to that region of the ice. Since the resurfacing operation cuts only a small thickness of ice each time, a visible indicator provides the operator with ample warning to increase the ice thickness long before the possibility of cutting into and damaging the floor elements. Once the coating of an indicator is removed and the warning color is visible, the operator may optionally reapply paint or another coating to the exposed portion of the indicator to re-camouflage the indicator.

The indicators, e.g., the plugs and/or blocks, are preferably made from a soft plastic material, e.g., polypropylene, and can be formed in any desired manner, e.g., molded or extruded and cut. Using plugs 142 as the indicators and pressing them into the holes 30 is advantageous because it provides a physical strengthening spike to resist ice shear from the upper sheet of ice 103. Using blocks 146 as indicators provides some shear resistance for the ice 103, but is also advantageous because it can be installed just by throwing or scattering the blocks 146 over the floor elements 16. That is, installation and manufacture is simplified as no precise placements are required and there are no tight manufacturing tolerances. If the blocks 146 are cubes and all of the sides are coated, then the blocks 146 would be properly oriented regardless of which side they were resting on. If, desired the blocks 146 can have longer dimensions in one or two directions to provide a greater indicator surface area.

Additionally, if the indicators are hollow, the top of the indicators can be made with a thin and easily breakable wall, and the center of the indicators can be filled with a colored fluid agent, preferably having a freezing temperature lower than water. If the ice resurfacing machine scrapes the top of the indicator, the top wall of the indicator will fracture and/or scrape off and the colored fluid inside will leak onto the surrounding ice. This will provide an even more visible warning to the operator that the ice is thin in that area.

The indicators are placed or scattered across the floor elements 16 in the rink so that they can give the appropriate warning if the ice thickness becomes low in any region. If the ice is melted and the flooring system 10 is used for another purpose, the indicators can easily be picked up, and reused if it is desired to use reconvert back to ice. If the user chooses to always use flooring system 10 for forming a sheet of ice, the indicators can optionally be fixed to the floor elements 16 in any suitable manner.

The thin ice warning system can also be used on any conventional ice forming surface need not be used on the floor system shown in the figures. For example, the indicators, e.g., cubes or blocks 146 can be placed on any base or base surface, like concrete, sand, plastic, etc., and frozen in part or in whole within the sheet of ice forming the skating surface. In the arrangement of FIG. 17, the base can be both the raised upper surface 18 or the foundation 19. In many conventional arrangements, the indicators would rest on a base having cooling tubes embedded therein.

Another major advantage achieved by this design is that the requirement to provide more than one set of game playing floor indicia is eliminated. For example, if the floor elements 16 are painted, coated, or otherwise colored, to provide hockey game playing indicia, i.e., red, blue, and goal lines, face off circles, and goal creases, the same set of game playing indicia may be visible through the ice. Accordingly, the same set of game playing indicia can therefore be used for floor or in-line hockey and for ice hockey. Further, advertisements and other indicia on the floor would also be visible regardless of whether the floor was being used for floor-based applications or ice-based applications.

Game playing lines, symbols, or logos, or any other indicia can be permanently applied to the floor elements 16 by providing thin ribbon-like pieces 145 of colored plastic, such as shown in FIG. 4. These ribbon-like pieces 145 can be heat welded to the floor for permanent markings. In lieu of permanently attaching these pieces to the floor elements 16, the indicia can be ribbon-like pieces 147, similar to the pieces shown in FIG. 4, except further provided with downwardly projecting pegs 149, such as shown in FIG. 2. The pegs 149 are sized and spaced to fit into the pattern of holes 30 on the floor elements 16. Thus, the indicia 147 with the pegs 149 can snap into the floor for quick assembly, and can easily and quickly be removed if desired. In both arrangements, it is preferred that the indicia pieces are thin, e.g., 1/16 inch or less, to minimize any effect that they may have on events that use the top surface 18 as a playing surface. Additionally, the edges of these indicia pieces 145, 147 may also be tapered to further minimize any effect that they may have on events that use the top surface 18 as a playing surface. The indicia pieces 145, 147 may optionally be textured and/or have holes therein to be superimposed over some of the holes 30 in the floor elements 16.

In cases where the floor system 10 is used for any non-ice outdoor application and exposed to high temperature and/or direct sunlight, if may be preferable to couple the floor elements 16 to a coolant distribution system, such as shown in FIGS. 1, 13, and 14 and previously described, to cool the floor elements 16 and maintain them at virtually any temperature desired. This prevents undesirable floor buckling and changes in size, texture, hardness, and feel to the floor elements 16. For outdoor use, the coolant distribution system can be a closed coolant system, an open coolant system, or a combination of both open and closed systems.

If a closed coolant system is used, the system would preferably be arranged as previously shown and described, having a cooling and pump unit 62 to cool and pump a coolant, e.g., antifreeze, through the channels 22. However, the coolant temperature would not need to be below 32° F., but only at a temperature sufficiently lower than the ambient air to cool the floor elements 16 by an amount sufficient to prevent buckling and any undesirable changes in size, texture, hardness, and feel.

If an open coolant system is used, an evaporative cooler can be used and additional water can be added to maintain satisfactory volume. One evaporative cooling device that could be used is a cooling tower properly sized for the rink size, local geographic environmental design conditions, and circulation pumps specifications. The cooling tower would preferably be a forced air cooling tower. This arrangement is beneficial because no refrigeration is required, the relative cost to cool the floor elements is small.

Figure 18:
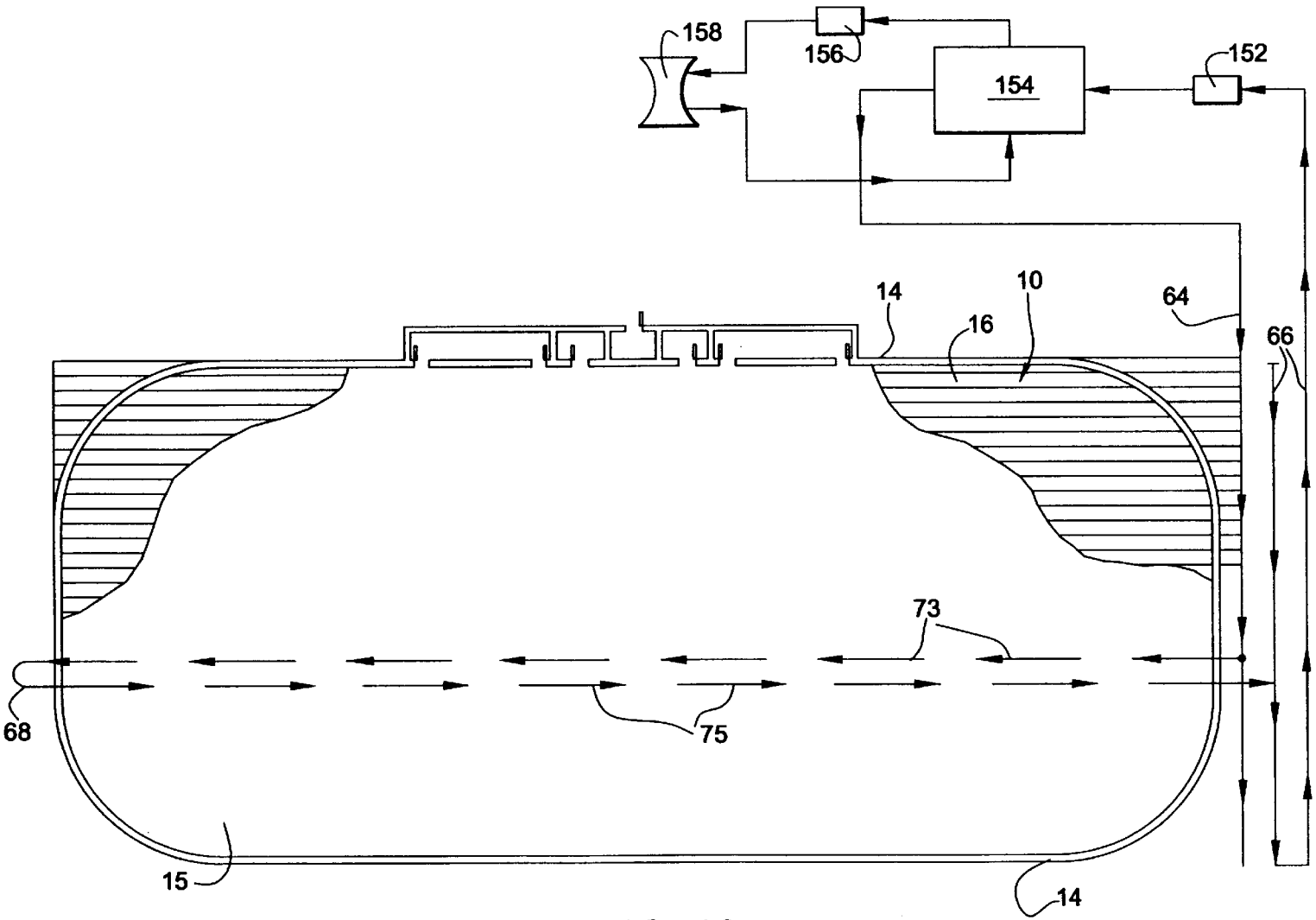
FIG. 18 is a schematic plan view of a hockey rink similar to FIG. 1 using a cooling tower with the coolant distribution system.

A combination of open and closed coolant systems can used, such as shown in FIG. 18. In this arrangement, the cooling and pump unit 62, takes the form of a pump 152 and a heat exchanger 154. A first coolant, e.g., antifreeze, is pumped via pump 152 through a loop including the headers 64 and 66, the floor elements 16, and the heat exchanger 154. A second loop having a pump 156 and an evaporative cooler 158, e.g., a cooling tower, and also including the heat exchanger 154 is provided so that a second coolant, preferably water, may be used to lower the temperature of the first coolant in the heat exchanger 154. The heat exchanger 154 may be any conventional heat exchanging device, typically one whereby the coolants remain physically separate and that one of the coolants travel in tubes that the other coolant passes over. This arrangement enables an evaporative cooler 158 to be used that enables the rink floor fluid loop to remain closed and not exposed to the atmosphere. This is may be preferable to a totally open coolant system because it avoids accumulation of foreign material within the floor system and it facilitates the control of algae products. If desired, in any of the cooling system types, an automatic thermostat may be used to regulate the temperature of the circulated fluid.

In cases where the floor system 10 is used for any non-ice outdoor application, if may be preferable to couple the floor elements 16 to the fluid distribution system, such as shown in FIGS. 1, 13, and 14, and previously described. This fluid distribution system will include a boiler or fluid heater 130, as shown in FIG. 1, in addition to, or in lieu of, the refrigeration unit. For example, in certain climates, the floor surface may be prone to the collection of condensation, especially during the overnight hours. Wet floors are know to significantly reduce traction, cause people to slip, and cause injuries. Wet floor surfaces are extremely hazardous to in-line skaters. Thus, by using the fluid heater 130 and circulating heated fluid through the channels 22, the temperature of the floor surface can be raised above dewpoint, where condensation can not occur.

The floor system 10 is also applicable for radiant heating. The interlocked floor sections 16 can be placed below a carpet or other covering, or serve as the floor surface in a commercial setting. Heated (or cooled) water is pumped through the channels. The difference in temperature between the ambient air and the fluid in the channels causes the ambient air in the regions around the floor to be heated (or cooled). The difference in air temperature causes natural convection to occur between the air in the passages and in the region of the floor, and the rest of the ambient air. If desired, forced air may be applied through the passages to increase the heating (or cooling) capacity.

The invention has been described in detail in connection with preferred embodiments. The preferred embodiments, however, are merely for example only and this invention is not restricted thereto. For example, while the floor system of the present invention is extremely beneficial for hockey surfaces, it also useful for basketball or soccer games, trade shows, or even car shows. Accordingly, it would be easily understood by those skilled in the art that variations and modifications can be easily made within this scope of this invention as defined by the appended claims.

What is claimed is:

1. An apparatus for providing a playing surface in a rink, said apparatus comprising: a floor element having a length and including an upper floor with a generally-planar top surface, a plurality of parallel supports vertically supporting the top surface above the foundation for substantially the entire length of the floor element, channels located within the parallel supports that extend substantially the entire length of the floor element, passages located below the top surface and between adjacent parallel supports, that extend substantially the entire length of the floor element, and a plurality of holes in the upper floor permitting fluid communication between the passages and the region immediately above the upper surface.

2. The apparatus of claim 1, further comprising a plurality of parallel floor elements, said floor elements being oriented side-by-side with adjacent floor elements being joined to each other to form a substantially continuous generally-planar top surface extending across the floor elements.

3. The apparatus of claim 2, wherein each of said floor elements includes a first locking element along one side and a second locking element along its opposite side, said first and second locking elements being complimentary shaped enabling a first locking element of one floor element to engage a second locking element of an adjacent floor element to lock the adjacent floor elements together.

4. The apparatus of claim 3, wherein the first and second locking elements extend substantially the entire length of each floor element, wherein said first locking element includes a vertical member and a lateral member extending laterally away from the vertical member, and said second locking element includes a vertically oriented receiving slot and a horizontally oriented lateral groove.

5. The apparatus of claim 4, wherein one of said first and second locking elements includes a concave bottom surface extending substantially the entire length of each floor element.

6. The apparatus of claim 1 wherein said generally-planar upper surface is matte textured.

7. The apparatus of claim 1 further comprising a forced air moving system for forcing air into said passages below the upper floor such that the forced air travels through said holes in the upper floor.

8. The apparatus of claim 1, further comprising a coolant distribution system for reducing the temperature of a coolant and moving the coolant through said channels.

9. The apparatus of claim 8, wherein the coolant distribution system reduces the temperature of the coolant below 32° F.

10. The apparatus of claim 9, further comprising frozen water disposed in said passages, in said holes, and on a layer above the top surface.

11. The apparatus of claim 9, further comprising frozen water disposed on a layer above the top surface and at least one ice level indicator frozen within said ice layer indicating when the layer of ice falls below a predetermined amount.

12. The apparatus of claim 11, wherein the indicator is frozen on the top surface of the upper floor.

13. The apparatus of claim 11, wherein the indicator extends through at least one of said holes in the upper floor.

14. The apparatus of claim 11, further comprising a plurality of ice level indicators disposed within the sheet of ice.

15. The apparatus of claim 8, wherein the coolant distribution system does not reduce the temperature of the coolant below 32° F.

16. The apparatus of claim 15, wherein the coolant distribution system includes an evaporative cooling device.

17. The apparatus of claim 16, wherein the evaporative cooling device is a cooling tower.

18. The apparatus of claim 8, wherein the coolant distribution system further comprises a heating device for increasing the temperature the coolant.

19. The apparatus of claim 8, wherein the coolant is antifreeze.

20. The apparatus of claim 8, wherein the coolant is water.

21. The apparatus of claim 1, further comprising a fluid distribution system having a fluid pump and a heating device for increasing the temperature of a fluid and moving the fluid through said channels.

22. The apparatus of claim 1, further comprising base members joining the lower portions of adjacent parallel supports together.

23. The apparatus of claim 1, wherein said channels are circular in cross-section and said passages are generally rectangular in cross section.

24. The apparatus of claim 1, wherein said holes above each passage are longitudinally spaced apart along the length of the floor element by a center-to-center distance of 2 inches or less.

25. The apparatus of claim 1, wherein said holes above each passage are longitudinally and laterally spaced from its adjacent holes.

26. The apparatus of claim 21, wherein said holes above each passage are spaced apart by a center-to-center distance of 2 inches or less.

27. An apparatus for providing a playing surface above a foundation in a rink, said apparatus comprising: a plurality of floor elements each having a length and a width and including an upper floor with a generally-planar top surface, a plurality of parallel supports vertically supporting the upper floor above the foundation for substantially the entire length of the floor element, channels located within the parallel supports that extend substantially the entire length of the floor element, passages located below the upper floor and between adjacent parallel supports, that extend substantially the entire length of the floor element, and a plurality of holes in the upper floor fluidly connecting a region immediately above the top surface with a region below the upper floor, said length of each floor element being at least 10 times the width, each of said plurality of floor elements being joined to at least one adjacent floor element in a side-by-side relationship.

28. The apparatus of claim 27, wherein said length of each said floor element being at least 50 times the width.

29. The apparatus of claim 28, wherein each said floor element extends entirely across the rink.

30. The apparatus of claim 27, wherein the holes fluidly connect the passages with the region above the top floor.

31. The apparatus of claim 27, wherein the holes fluidly connect the channels with the region above the top floor.

32. The apparatus of claim 27, wherein said plurality of floor elements is a first plurality of floor elements, said apparatus further comprising a second plurality of floor elements each having a length and a width and including an upper floor with a generally-planar top surface, a plurality of parallel supports vertically supporting the upper floor above the foundation for substantially the entire length of the floor element, channels located within the parallel supports that extend substantially the entire length of the floor element, passages located below the upper floor and between adjacent parallel supports, that extend substantially the entire length of the floor element, and a plurality of holes in the upper floor fluidly connecting a region immediately above the top surface with a region below the upper floor, said length of each floor element of said second plurality of floor elements being at least 10 times the width, each of said second plurality of floor elements being joined to at least one adjacent floor element in a side-by-side relationship, said second plurality of floor elements being spaced from said first plurality of floor elements in the direction of their lengths.

33. The apparatus of claim 32, further comprising a cover element disposed between said first and second pluralities of floor elements.

34. An apparatus for providing a playing surface for a rink, said apparatus comprising: a plurality of floor elements, each floor element having a length and a width and including an upper floor with a generally-planar top surface, plurality of tubes integrally formed with the upper floor vertically supporting the top surface for substantially the entire length of the floor element, and a plurality of holes in the upper floor permitting water on the top of the top surface to enter the holes and drain below the upper floor, said floor elements being oriented side-by-side with adjacent floor elements being joined to each other to form a substantially continuous generally-planar top surface extending across the floor elements.

35. The apparatus of claim 34, wherein said floor elements extend across the entire rink, and said length of each said floor element being at least 50 times the width.

36. The apparatus of claim 35, wherein each of said floor elements includes a first locking element along one side and a second locking element along its opposite side, said first and second locking elements being complimentary shaped enabling a first locking element of one floor element to engage a second locking element of an adjacent floor element to lock the adjacent floor elements together.

* * * * *